US006874966B2

(12) United States Patent
Duqueroie et al.

(10) Patent No.: US 6,874,966 B2
(45) Date of Patent: Apr. 5, 2005

(54) DEVICE COMPRISING A CASE AND AN APPLICATOR

(75) Inventors: Florent Duqueroie, Paris (FR); Nicolas Albisetti, Clichy (FR)

(73) Assignee: L'Oreal, Paris (FR)

( * ) Notice: Subject to any disclaimer, the term of this patent is extended or adjusted under 35 U.S.C. 154(b) by 3 days.

(21) Appl. No.: 10/321,703

(22) Filed: Dec. 18, 2002

(65) Prior Publication Data

US 2003/0147686 A1 Aug. 7, 2003

(30) Foreign Application Priority Data

Dec. 21, 2001 (FR) ..... 01 16786

(51) Int. Cl.[7] ..... A46B 11/00

(52) U.S. Cl. ..... 401/129; 401/77; 401/125; 401/127; 132/294; 132/314; 132/317

(58) Field of Search ..... 401/76, 77, 123–130, 401/140; 132/293–295, 297, 298, 300, 303, 313, 314, 317, 318, 320; 206/235, 581, 361; D28/78, 85

(56) References Cited

U.S. PATENT DOCUMENTS 1,067,596 A * 7/1913 Fesler ..... 401/269
3,397,707 A * 8/1968 Aversa ..... 132/317
3,760,820 A 9/1973 Seidler
4,777,969 A * 10/1988 Holloway ..... 132/314
4,984,920 A * 1/1991 O'Neill ..... 401/127
5,556,216 A * 9/1996 Mayesh ..... 401/127
6,073,634 A 6/2000 Gueret
6,298,863 B1 10/2001 Byun
2001/0032656 A1 10/2001 Kingsford et al.

FOREIGN PATENT DOCUMENTS

WO WO 01/78551 10/2001

* cited by examiner

*Primary Examiner*—Tuan Nguyen
(74) *Attorney, Agent, or Firm*—Hunton & Williams LLP

(57) ABSTRACT

A packaging and applicator device is disclosed. The device comprising a compartment for receiving a receptacle containing a substance; a applicator capable of being releasably fixed to the device; a first opening through which the applicator can take the substance; a shutter associated with the first opening and capable of taking a closed position and an opened position; a transmission member capable of being driven in displacement by the applicator to move the shutter into at least one of the open and closed positions; and a second opening distinct from the first and through which the receptacle can be inserted in said compartment, by being moved relative to the transmission member.

47 Claims, 4 Drawing Sheets

DEVICE COMPRISING A CASE AND AN APPLICATOR

CROSS REFERENCE TO RELATED APPLICATIONS

The present application claims the benefit of FR 01/16, 786 filed Dec. 21, 2001, the disclosure of which is hereby incorporated by reference.

BACKGROUND OF THE INVENTION (i) Field of the Invention

The present invention relates to devices for applying at least one substance, in particular devices comprising a case having an axis, an applicator that is separable from the case, and a receptacle containing the substance, said receptacle being received at least in part inside the case, the case having at least one side opening through which the substance can be taken by means of the applicator.

(ii) Description of Related Art

European patent application EP A21 118 286 provides examples of devices in which the substance to be applied is contained in a cup which can be put into place in a housing for receiving it when the applicator is separated from the case. In FIG. 28, there is described an embodiment including a transmission member, a case and an applicator. The transmission member has slots, each of which is generally L-shaped. In such embodiment, the applicator has studs capable of engaging in the slots, and the case has threads cooperating with the studs. The bottom limb of the L, which corresponds to the bottoms of the slots, enables the applicator to be turned relative to the transmission member after the applicator and the transmission member have been coupled together. Such turning, however, can cause the studs of the applicator to be moved past the threads of the case in an undesirable fashion.

Thus, there exists a need whereby the transmission member and the applicator are suitable for being coupled to turn together, and the transmission member is configured to avoid the applicator turning relative to the transmission member after the applicator has been coupled to turn with the transmission member.

There also exists a need in particular to provide a device whereby, for example, it is of a structure that is more easily manufactured.

SUMMARY OF THE INVENTION

In one of its aspects, the invention provides a packaging and applicator device comprising: (i) a case for receiving a receptacle containing a substance, (ii) an applicator capable of being releasably fixed to the case; (iii) a first opening in the case through which the applicator can take the substance, (iv) a shutter associated with the first opening and capable of being opened and/or closed; (v) a transmission member capable of being driven in displacement by the applicator to move the shutter into at least one of the open and closed positions; and (vi) a second opening in the case distinct from the first and through which the receptacle is designed to be inserted, by being moved relative to the transmission member.

In an aspect of the invention, the first and second openings are made in a case having an axis.

In another aspect of the invention, the receptacle is inserted into the case through the second opening, by being displaced along the axis of the case.

In another aspect of the invention, the applicator is free to turn relative to the case while remaining secured to the transmission member.

In yet another aspect of the invention, the shutter is free to turn relative to the case and the transmission member is suitable for transmitting the turning movement of the applicator relative to the case to constitute turning movement of the shutter relative to the case.

In this case in particular, the transmission member may be suitable for cooperating with the applicator in such a manner that the applicator can rotate the transmission member.

In an aspect of the invention, the applicator includes at least one fastening portion in relief suitable for cooperating with a complementary portion in relief of the transmission member.

In an embodiment of the invention, the transmission member includes the shutter. Thus, the shutter need not form an integral portion of the receptacle. The shutter may be made integrally with the transmission member by molding a plastics material.

The receptacle may be engaged in a housing of the transmission member, the housing presenting an opening that can be brought into register with the side opening of the case to enable substance to be taken. In such an embodiment, the transmission member may be of substantially the same length as the case, thereby making it easier to handle.

In another embodiment of the invention, the receptacle includes the shutter, the shutter not necessarily forming an integral part of the transmission member. The receptacle may be made integrally with the shutter by molding a plastics material, the shutter possibly being constituted by a wall that also serves to define at least part of a housing for receiving the substance. The receptacle and the transmission member may be placed end to end in the case. Such a disposition may enable the receptacle to be given volume that is greater than when the receptacle is received in a housing of the transmission member.

In an aspect of the invention, the receptacle is configured to be capable of being fixed to the transmission member, in particular by snap-fastening.

The receptacle may be fixed on the transmission member, e.g. automatically at the end of a movement for inserting the receptacle in the case.

In an aspect of the invention, the transmission member and the applicator are suitable for being coupled to turn together, and the transmission member is configured to avoid the applicator turning relative to the transmission member after the applicator has been coupled to turn with the transmission member.

The case may include at least one portion in relief extending circumferentially, in particular a shoulder, and the transmission member includes at least one element suitable for cooperating with said portion in relief to allow the transmission member to turn relative to the case while preventing axial displacement in at least one direction of the transmission member relative to the case.

The transmission member may include at least one slot, in particular a slot having two opposite edges each having at least one substantially rectilinear portion parallel to an axis of the device, a portion in relief of the applicator, in particular a stud being capable of being engaged in said slot, to transmit a turning movement from the applicator to the transmission member.

The transmission member may include two diametrically-opposite slots, and preferably four slots, and the applicator may include at least two portions in relief, in particular two studs suitable for engaging in said slots, and preferably four studs.

The slots may present outwardly-diverging openings, said openings following one another circumferentially in such a manner that a user returning the applicator into the case can easily engage the studs in the slots without needing initially to take care to position the applicator angularly with precision relative to the case. The transmission member may be put into place in the case by being inserted axially therein. The slots may define tongues between one another, said tongues possibly being adapted to snap-fasten on the case, in particular on the above-mentioned annular shoulder, when the transmission member is fully inserted into the case.

The case may include inside threading, the applicator being suitable for cooperating with said threading in such a manner that turning the applicator relative to the case causes the applicator to be moved axially relative to the case. The threading may comprise four parallel threads, particularly when the applicator has four studs.

The transmission member may include at least a first fixing element, the receptacle possibly including at least a second fixing element at one end suitable for cooperating with the first fixing element during positioning of the receptacle so as to secure the receptacle to the transmission member. The second fixing element may comprise at least one fixing tab, and the receptacle preferably has two fixing tabs suitable for snap-fastening on the transmission member when the receptacle has been put completely into place. The first fixing element may comprise at least one opening suitable for receiving a catch on a fixing tab.

The receptacle may have at least a first positioning portion in relief, and the transmission member has at least a second positioning portion in relief suitable for co-operating with the first positioning portion so as to encourage positioning of the receptacle in a predetermined position relative to the transmission member, each of the first and second positioning portions in relief preferably including at least one sloping surface. For example, one of the receptacle and the transmission member may have an element defining a V-groove and the other of the receptacle and the transmission member has an element with a profile in a plane containing the axis of the case that is substantially complementary to said groove.

In another aspect, the invention comprises a case which may have at least a first portion in relief on its inside face, in particular two diametrically-opposite splines parallel to the axis of the case, the transmission member then having at least one second portion in relief suitable for going past said first portion in relief when the transmission member is turned relative to the case. Said second portion in relief may go past said first portion in relief substantially at the end of the movement for fixing the applicator to the case, and as it goes past it may generate a hard point feeling that informs the user that the applicator has been properly fixed to the case.

The transmission member or the receptacle may include at least a first abutment, and in particular two diametrically-opposite abutments suitable for cooperating with at least one abutment of the case, and in particular abutments, so as to limit turning displacement relative to the case to approximately one-fourth of a turn, for example.

In a particular embodiment of the invention, the substance may form a cake.

The applicator may be configured to enable the substance to be applied to the lips or to the eyelids, to the eyelashes or to the eyebrows.

The device may include a shutter made of a material that is at least partially transparent or translucent.

In another aspect, the invention provides a method of assembling a substance packaging and applicator device comprising a case and an applicator, the case having an opening through which the substance is taken by means of the applicator, the method comprising the following steps: a) presenting the case and the applicator secured to each other to an assembly station; and b) inserting a supply of substance into the case through an opening of the case that is different from the opening through which the substance is taken by means of the applicator, the case and the applicator being secured to each other while the supply of substance is being inserted into the case.

Manufacture of the device is made easier when the case and the applicator can be presented to an assembly station attached to each other, and the operation of inserting the receptacle containing the substance into the case, in particular along the axis of the case, is an operation that is relatively easy to automate.

The receptacle may contain the substance directly, i.e., the substance may be in contact with the wall of the receptacle which defines the substance-receiving housing. In a variant, the substance may be contained in a cup, e.g., a cup of plastics material or of metal, that is fitted to the receptacle.

In one particular aspect of the invention, the receptacle containing the substance is free to turn relative to the case about the axis of the case. The device may include a motion transmission member enabling a turning movement of the applicator relative to the case to be transformed into a turning movement of the receptacle relative to the case. While the receptacle is being put into place in the case, the receptacle may be secured to said transmission member.

The applicator may have at least one fastening portion in relief suitable for co-operating with at least one corresponding portion in relief enabling the applicator to be retained in the case, and the substance is inserted into the case by moving relative to said at least one corresponding portion in relief. The transmission member may include said at least one corresponding portion in relief.

The device may include a receptacle containing the substance, said receptacle being suitable for being received at least in part in the case, the case having at least one lateral opening through which substance can be taken with the applicator.

Under such circumstances, the assembly method may comprise the following steps: a) presenting the case and the applicator secured to each other to said assembly station; and b) inserting the receptacle containing the substance into the case in said station while the case and the applicator are secured to each other, said insertion taking place along the axis of the case.

In another aspect, the invention provides a device for applying a substance, which device may comprise a case having an opening through which the substance can be taken, and an applicator suitable for being fixed to the case and for being separated therefrom, said applicator having four studs suitable for engaging in multiple threading of the case.

The case may include an insert, in particular a transmission member for transmitting movement, enabling the turning movement of the applicator to be transmitted to a shutter capable of taking up a position in which it prevents access to the substance through the above-mentioned opening. This transmission member may include four slots of openings that diverge outwardly and into which the studs can be engaged. The slots may present opposite edges having mutually parallel rectilinear portions.

In another aspect, the invention provides a device for applying at least one substance, which device may comprise a case having an axis and provided with at least one side opening, an applicator suitable for being fixed releasably to the case, a shutter that is movable relative to the case at least between a position allowing substance to be taken through the side opening and a position preventing access to the substance through the side opening, a transmission member for transmitting movement of the applicator relative to the case so as to cause the shutter to move relative to the case, said movement taking place between said positions, and a receptacle containing the substance, the receptacle suitable for being inserted into the case along the axis of the case with the transmission member already in place inside the case.

BRIEF DESCRIPTION OF THE DRAWINGS

The invention will be better understood on reading the following description and on examining the accompanying drawings, which form an integral part of the description, and in which.

DETAILED DESCRIPTION OF PREFERRED EMBODIMENTS

Figure 1:
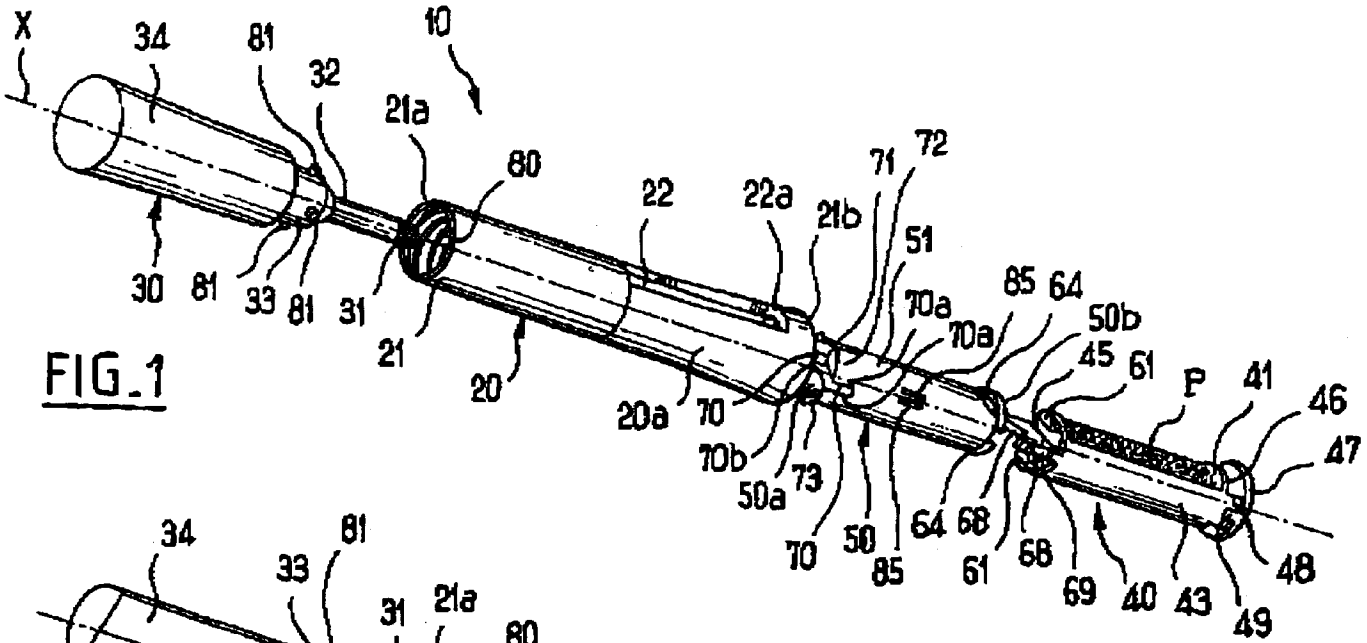
FIG. 1 is an exploded perspective view of an applicator device in accordance with one embodiment of the invention.

Throughout the present text, including in the claims, the term "comprising a" should be understood as being synonymous with "comprising at least one" unless the contrary is specified.

The applicator device 10 shown in FIGS. 1 to 4 comprises a case 20 and an applicator 30, which applicator 30 can be secured to the case 20 when not in use. In the embodiment shown, the case 20 is elongate in shape along a longitudinal axis X and comprises a tubular body 21 open at two opposite ends, openings 21*a* and 21*b*. The body 21 is made by injecting a rigid and opaque thermoplastic material, for example. The case 20 also has a side opening 22, which opening 22 is substantially rectangular in shape in the embodiment shown. The opening 22 has a short side in the range 0.5 centimeters (cm) to 1.5 cm, and a long side in the range 3 cm to 5 cm, for example. In the embodiment shown, the opening 22 is made in a portion 20*a*, which occupies a little more than half of the body 21, beside the opening 21*b*, for example. The edge 22*a* of the opening 22 adjacent to the opening 21*b* is spaced apart therefrom by a distance of about 0.5 cm, for example.

The applicator 30 has an applicator element 31 of any kind at one end, for example in the form of a brush. In the embodiment shown, the applicator element 31 has a rigid rod 32 at one end connected to a handle 34 via an intermediate portion 33. The intermediate portion 33 can also constitute an element for closing the opening 21*a* of the case 20.

Figure 3:
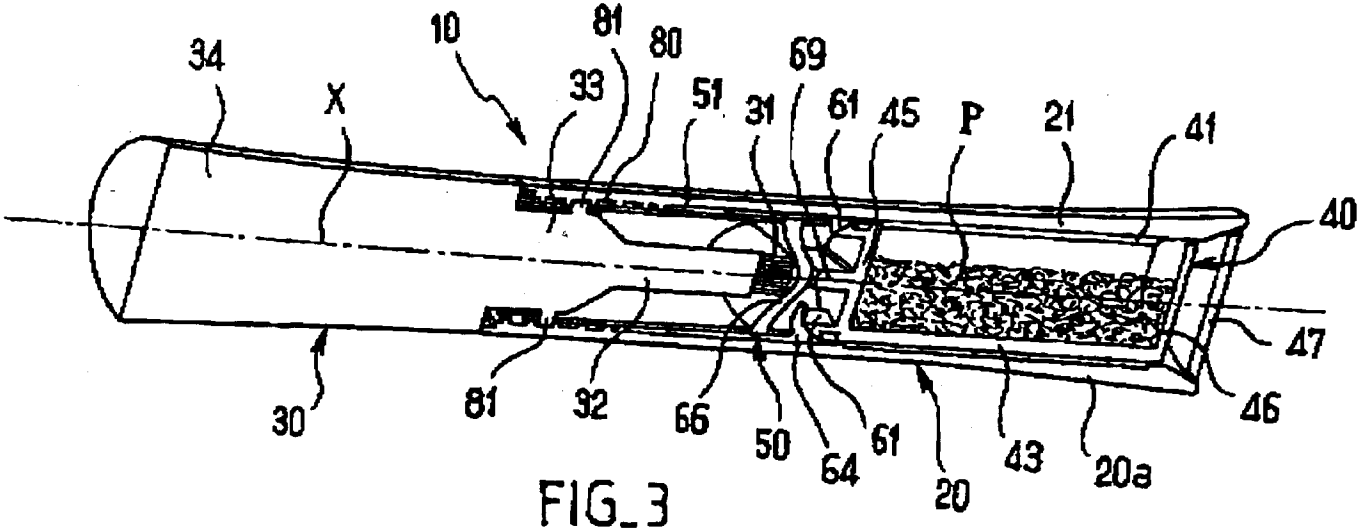
FIG. 3 is an axial section view of the applicator device of FIG. 1 with the applicator device in place in the case.

As seen in FIG. 3, a receptacle 40 containing a substance P is received in the case 20, and the device 10 is configured so as to enable a user to access the substance P through the side opening 22 when the receptacle 40 is in a predetermined position relative to the case 20.

By way of example, the substance P is a cosmetic or a dermatological care product. The term "cosmetic" is used in the meaning specified in EEC Directive 76/768, as modified by EEC Council Directive 93/35 of Jun. 14, 1993.

By way of example, the substance P can be in the form of a compacted powder or it can be cast into the receptacle or into a cup placed in the receptacle and allowed to solidify. The substance P may be suitable for dispersing in contact with a moist applicator element. The substance P may form a coherent mass. The substance P may adhere to the wall of the housing which contains it.

In the embodiment corresponding to FIGS. 1 to 4, the receptacle 40 is free to turn relative to the case 20 about the axis X between at least one position in which an opening 41 of the receptacle 40 giving access to the substance P is positioned behind the side opening 22 so as to enable a user to take substance P, and at least one position in which the opening 41 of the receptacle 40 is offset angularly, e.g., through about one-fourth of a turn from the side opening 22 and is completely separate therefrom, so that the user can no longer access the substance P, a shutter-forming wall 43 that is circularly cylindrical about the axis X of the receptacle 40 then taking up a position behind the side opening 22.

In the embodiment shown, the wall 43 also defines the housing containing the substance P. The outside diameter of the wall 43 is selected so as to enable it to fit with relatively little clearance inside the portion 20*a* of the case 20, the inside surface 21*c* of said portion 20*a* being circularly cylindrical about the axis X.

The housing for the receptacle 40 containing the substance P is axially defined by two partitions 45 and 46 which extend perpendicularly to the axis X in the embodiment described. A third partition 47 separates the partition 46 from the outside of the case 20 when the receptacle 40 is in place inside the case 20, as can be seen in FIG. 3. This partition 47 is connected to the wall 43 by two diametrically-opposite bridges of material 48 each of which has an abutment 49 formed thereon.

In the embodiment shown, the turning of receptacle 40 enables access to the substance to be closed or opened. This turning movement is obtained by turning the applicator 30 about the axis X, a transmission member 50 enabling the applicator 30 to be coupled to turn with the receptacle 40.

In the embodiment shown, the transmission member 50 comprises a tubular body 51 about the axis X, the body 51 being opened at one end 50*a* to enable the applicator element 31 to be engaged therein, together with the rod 32 and the intermediate portion 33 of the applicator 30, as can be seen in FIG. 3.

The end 50*b* of the transmission member 50, opposite from end 50*a*, is configured so as to enable the receptacle 40 to be secured to the transmission member 50.

In the embodiment shown, the receptacle 40 is provided beside its end remote from the partition 47 with two fixing tabs 61 that connect to the partition 45 at two locations that are substantially diametrically opposite, each tab 61 being provided with a cap 62 suitable for snap-fastening in a corresponding recess 64 of the transmission member 50. The transmission member 50 has a partition 66 constituting the end wall of the housing receiving the applicator 30. The surface of the partition 66 facing towards the opening 50*b* defines a point having two substantially plane opposite faces of triangular outline making an angle relative to each other. These faces are interconnected by two opposite convex faces. A wall 69 is connected to the partition 45. This wall 69 has two faces 68 for coming into contact with the above-mentioned faces of the partition 66. When the wall 69 is observed in a direction perpendicular to its plane, the two faces 68 define a V-groove suitable for engaging on the partition 66. When the receptacle 40 and the transmission member 50 are brought together, the partition 66 and the wall 69 cooperate so that the tabs 61 snap-fasten appropriately in the recesses 64, the receptacle 40 then being in a predetermined angular orientation relative to the transmission member 50.

Beside the opening 50*a*, the transmission member 50 has four slots 70 each having two opposite edges with two rectilinear portions 70*a* that are substantially parallel to the axis X. These four slots 70 are disposed at 90° intervals relative to one another around the axis X and between them they define tongues 72, each tongue 72 being provided with a respective tooth 73.

Beside the opening 21*a*, the case 20 has an annular shoulder 75 and the teeth 73 of the tongues 72 are suitable for bearing axially against said shoulder 75 when the transmission member 50 has been fully inserted into the case 20 through the opening 21*b*.

Beside the opening 21*a*, the case 20 has threading 80 made up of multiple threads and the applicator 30 is configured so as to be capable of cooperating with the threading 80.

In the embodiment shown, the intermediate portion 33 has four studs 81 disposed at 90° intervals from one another about the axis X. In the embodiment described, each of these studs 81 is circularly cylindrical in shape about an axis that is perpendicular to the axis X.

Figure 4:
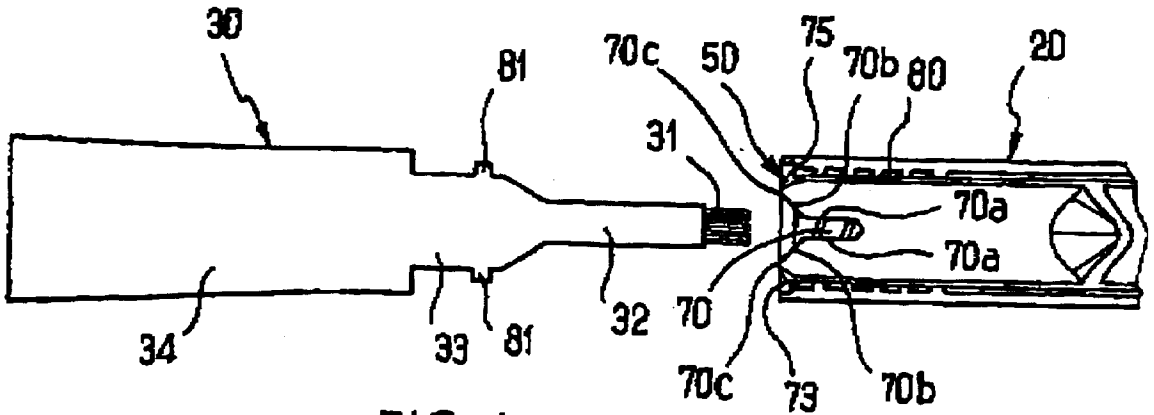
FIG. 4 is an axial section view of the applicator device and the end of the case into which the applicator device can be introduced.
Figure 5:
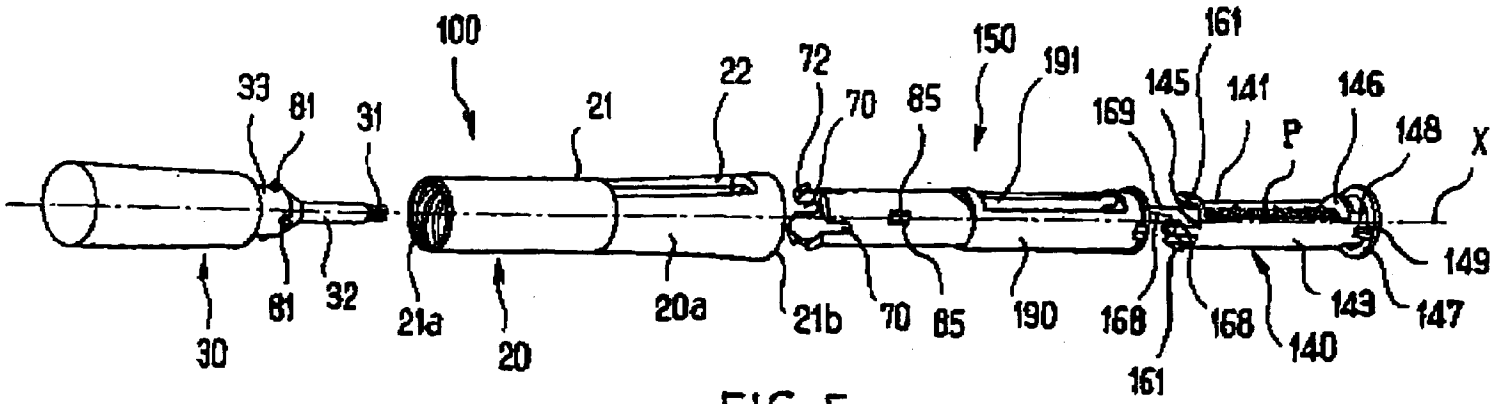
FIG. 5 is an exploded perspective view of an applicator device in accordance with one embodiment of the invention.
Figure 6:
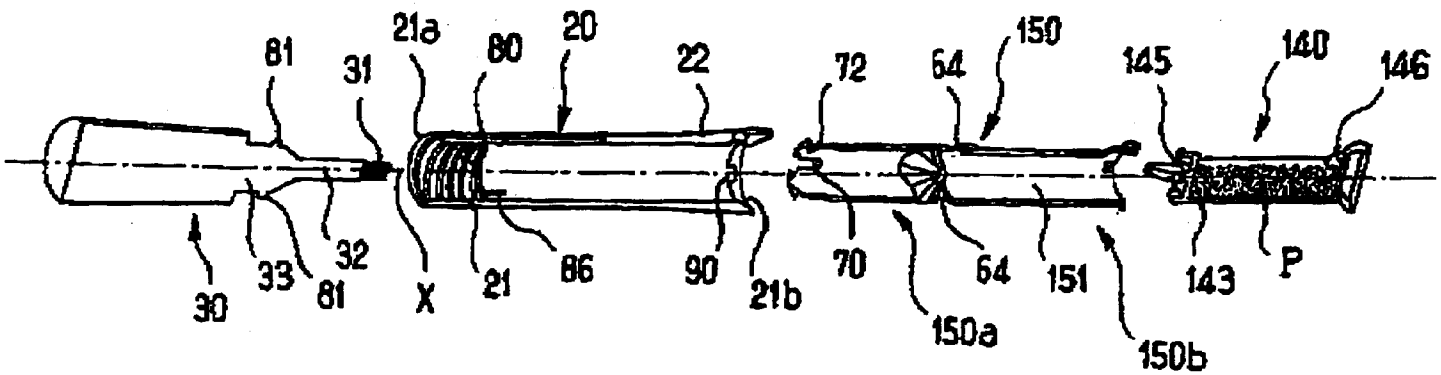
FIG. 6 is an exploded axial section view of the applicator device of FIG. 5.
Figure 7:
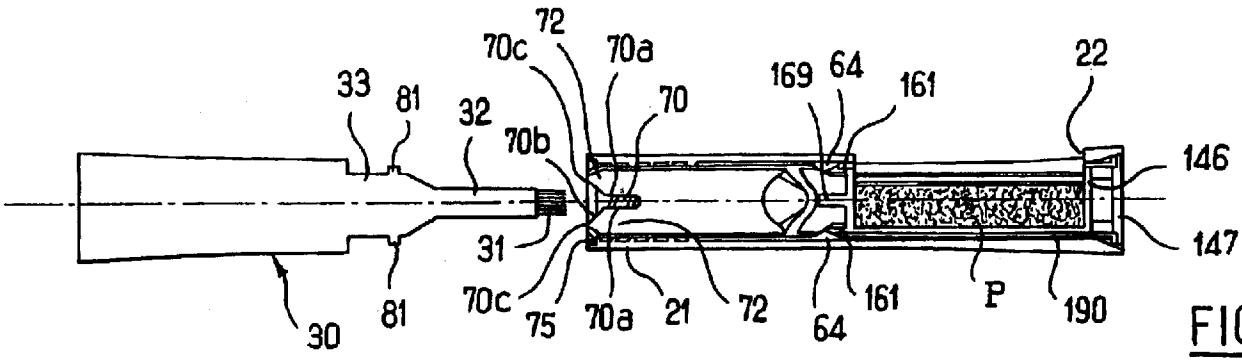
FIG. 7 is an axial section view of the applicator device of FIG. 5 and the case in the separated state.
Figure 8:
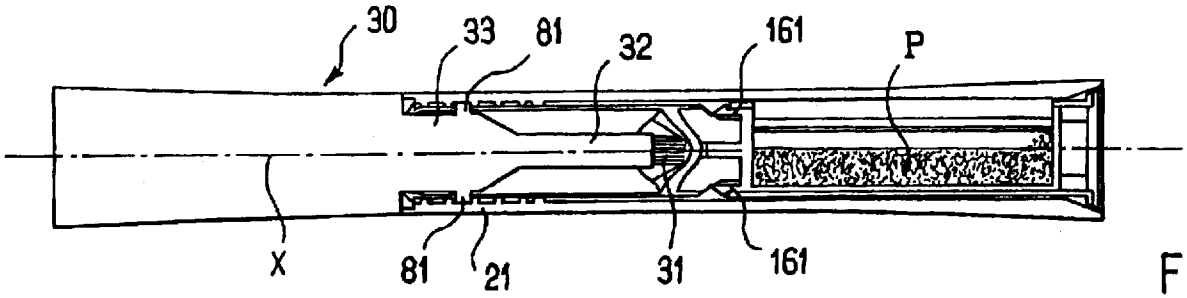
FIG. 8 is an axial section view of the applicator device of FIG. 5 in place in the case.

The diameter of each stud 81 corresponds substantially to the distance between the rectilinear portions 70*a* of a slot 70, such that once the studs 81 have engaged between the rectilinear portions 70*a*, no rotation of the applicator 30 relative to the transmission member 50 is possible. The rectilinear portions 70*a* run into outwardly-diverging edges 70*b* defining points 70*c*, as can be seen in FIG. 4, thus facilitating engagement of the studs 81 into the slots 70. In the embodiment described, the multiple threading 80 has four threads which are mutually parallel.

Each stud 81 is suitable for cooperating through a slot 70 with one of the threads of the multiple threading 80 so that turning the applicator 30 relative to the case 20 causes the applicator 30 to be moved axially inside the case 20.

Figure 2:
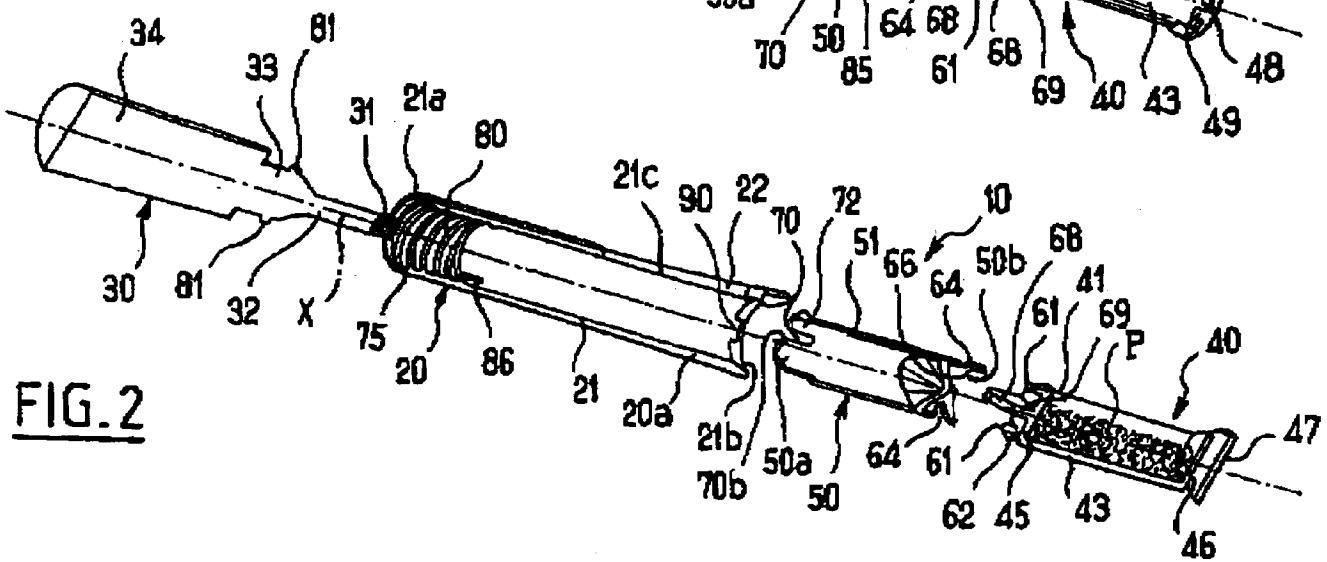
FIG. 2 is an exploded axial section view of the applicator device of FIG. 1.

As can be seen more particularly in FIGS. 1 and 2, the transmission member 50 has two splines 85 parallel to the axis X and suitable for taking up positions on either side of spline 86 of the case, likewise parallel to the axis X. When the applicator 30 is turned relative to the case 20, turning the transmission member 50 causes one of the splines 85 to go past the spline 86, thereby creating a hard point feeling which may also be accompanied by an audible click being emitted.

Beside the opening 21*b*, the case 20 has two diametrically-opposite abutments 90 for cooperating with the abutment 49 to limit turning displacement of the assembly constituted by the receptacle 40 and the transmission member 50 inside the case. The above-specified assembly is thus free to turn relative to the case 20 between a closed position in which the wall 43 presents access to the substance P, and an open position in which the user can take substance P through the opening 22 by means of the applicator element 31.

To manufacture the device 10, it is possible to proceed as follows.

It is assumed that the case 20, the applicator 30, the receptacle 40, and the transmission member 50 have already been made.

The transmission member 50 has been installed inside the case 20 through the opening 21*b* and the applicator 30 is screwed onto the case 20. The resulting assembly can be taken to a post for assembling the receptacle 40, a substance P having already been introduced therein, either directly or by means of a cup (not shown).

The receptacle 40 containing the substance P is inserted through the opening 21*b* into the case 20, the tabs 61 snap-fastening in the recesses 64. Cooperation between the partition 66 and the faces 68 of the wall 69 facilitates proper angular positioning of the receptacle 40 relative to the transmission member 50. When the receptacle 40 is in place inside the case 20, the transmission member 50 is positioned relative to the case 20 in such a manner that the wall 43 of the receptacle 40 closes the side opening 22.

To use the device 10, the user unscrews the applicator 30, thereby causing the wall 43 to be fully superposed with the wall of the case 20. The substance P can be taken by causing the applicator element 31 to move back and forth in contact with the substance P parallel to the axis X of the case, passing through the side opening 22.

As shown in FIGS. 5 to 8, device 100 is described below. Device 100 has certain elements that are identical with those of the device 10 and they are given the same reference numerals in the figures.

As in the embodiment of FIGS. 1 to 4, the transmission member 50 occupies a fraction only of the length of the case 20, the remainder of the length of the case 20 being occupied by the receptacle 40 in the variant shown in FIGS. 5 to 8. The transmission member 150 extends over substantially the entire length of the case 20 and defines a housing 151 in which the receptacle 140 can be received. The receptacle 140 has a wall 143 defining a housing containing the substance P, which wall 143 is circularly cylindrical about the axis X. An opening 141 gives access to the substance P contained in the housing of the receptacle 140, said housing being defined axially by partitions 145 and 146. The partition 146 is separated from the outside when the receptacle 140 is in place inside the case 20 by a partition 147 which is connected by bridges of material 148 to the wall 143. Abutments 149 are made on the bridges of material 148 to cooperate with the abutments 90 of the case 20.

The receptacle 140 has a wall 169 which performs the same function as the above-described wall 69, having two faces 168 defining a V-groove. The receptacle 140 also has two tabs 161 for enabling the receptacle 140 to be fixed to the transmission member 150, in the same manner as the above-described tabs 61.

The transmission member 150 has a first portion 150*a* substantially identical to the above-described transmission member 50 and a second portion 150*b* extending in line with the first portion 150*a* and defining a housing 151 in which the receptacle 140 is received. The second portion 150*b* has a wall 190 with a side opening 191. The wall 190 which is circularly cylindrical about the axis X can act as a shutter for preventing access to the substance P contained in the receptacle 140.

In order to manufacture the device 100, the case 20, the applicator 30, the receptacle 140, and the transmission member 150 are made initially.

The transmission member 150 is inserted into the case 20 through the opening 21*b* until the teeth 73 of the tongues 72 snap-fasten against the shoulder 75. The applicator 30 is then put into place on the case 20, the studs 81 engaging in the slots 70 and cooperating with the threading 80.

Once the applicator 30 has been screwed home into the case 20, the wall 190 of the transmission member 150 takes up a position behind the side opening 22 and closes the case 20.

The assembly can be delivered in this form to a station for putting the receptacle 140 into place, which receptacle 140 has already been filled with the substance P, either by casting the substance directly into the housing of the receptacle 140 as defined by the wall 143 and the partitions 145 and 146, or else by putting a cup containing the substance P into place in said housing.

The receptacle 140 is inserted axially into the transmission member 150 through the opening 21*b* of the case 20 until the tabs 161 snap-fasten in the recesses 64. The partition 146 bears axially against the end wall of the transmission member 150. The partition 145 has a free edge that is circular and it closes access to the inside space of the case containing the wall 169. The partition 146 also has a free edge that is circular in outline, and it fits closely in the wall 190.

Figure 10:
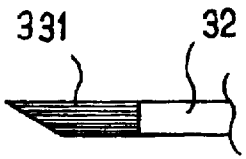
FIG. 10 is a partial perspective view of an applicator element in accordance with one embodiment of the invention.
Figure 9:
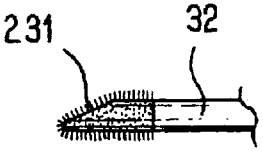
FIG. 9 is a partial perspective view of an applicator element in accordance with one embodiment of the invention.

In all of the examples described above, the applicator element 31 could be an element other than a brush, and in particular it could comprise a flocked endpiece 231, as shown in FIG. 9, or an elastomer endpiece 331, as shown in FIG. 10. The applicator element could also be constituted by a mascara brush or a comb for the eyelashes or the eyebrows.

Naturally, the invention is not limited to the embodiments described above. In particular, the case could be given shapes other than those shown in the drawings. The applicator could be fixed to the case other than by screw engagement.

The receptacle may contain a plurality of substances. For example, the receptacle may contain at least two different substances in at least two housings accessible through the side opening, simultaneously or otherwise.

While the present invention has been described here in detail in relation to its exemplary embodiments, it is to be understood that this disclosure is only illustrative and exemplary of the present invention and is made to provide an enabling disclosure of the invention. Accordingly, the foregoing disclosure is not intended to be construed or to limit the present invention or otherwise to exclude any other such embodiments, adaptations, variations, modifications or equivalent arrangements.

What is claimed is:

1. A packaging and applicator device comprising:

a receptacle for containing a substance, a case for receiving the receptacle;

an applicator realisably fixed to the case;

a first opening in the case through which the applicator can take the substance;

a shutter associated with the first opening and capable of taking a closed position and an opened position;

a transmission member capable of being driven in displacement by the applicator to move the shutter into at least one of the open and closed positions; and a second opening in the case trough which the receptacle can be inserted into the case by being moved relative to the transmission member.

2. A device according to claim 1, wherein the case has an axis.

3. A device according to claim 2, wherein the receptacle is insertable into the case through the second opening by being displaced along the axis of the case.

4. A device according to claim 2, wherein the applicator is free to turn relative to the case while remaining secured to the transmission member.

5. A device according to claim 4, wherein the shutter is free to turn relative to the case, and movement of the applicator relative to the case causes the transmission member to cause the shutter to turn relative to the case.

6. A device according to claim 1, wherein the applicator includes at least one fastening portion in relief configured to cooperate with a complementary portion in relief of the transmission member.

7. A device according to claim 6, wherein said at least one fastening portion is a stud and said at least one complementary portion is a slot.

8. A device according to claim 1, wherein the transmission member includes the shutter.

9. A device according to claim 8, wherein the shutter is formed integrally with the transmission member.

10. A device according to claim 8, wherein the shutter and integral transmission member are formed of a molded plastic material.

11. A device according to claim 1, wherein the receptacle includes the shutter.

12. A device according to claim 11, wherein the receptacle is formed integrally with the shutter.

13. A device according to claim 11, wherein the receptacle and integral shutter are formed of a molded plastics material.

14. A device according to claim 1, wherein the receptacle is configured to be snap-fastened to the transmission member.

15. A device according to claim 1, wherein the transmission member and the applicator are capable of being coupled to turn together.

16. A device according to claim 1, wherein the case comprises at least one portion in relief extending circumferentially and wherein the transmission member comprises at least one element cooperating with said portion in relief such that the transmission member turns relative to the case while preventing axial displacement in at least one direction of the transmission member relative to the case.

17. A device according to claim 16, wherein said portion in relief is a shoulder.

18. A device according to claim 16, wherein the transmission member includes two diametrically opposite slots, and wherein the applicator includes at least two portions in relief capable of engaging in said slots.

19. A device according to claim 18, wherein the transmission member includes four slots and wherein the applicator includes four studs capable of engaging in said slots.

20. A device according to claim 1, wherein the transmission member includes at least one slot, and the applicator includes at least one portion in relief engageable with said at least one slot.

21. A device according to claim 20, wherein the at least one slot comprises two opposite edges each having at least one substantially rectilinear portion parallel to an axis of the device.

22. A device according to claim 20, wherein said portion in relief is a stud.

23. A device according to claim 22, wherein the case comprises at least one inside threading, wherein the applicator is configured for cooperating with said threading so that turning the applicator relative to the case is accompanied by an axial displacement of the applicator relative to the case.

24. A device according to claim 20, wherein the transmission member is configured for axial insertion into the case, the transmission member including a plurality of slots defining tongues between one another, wherein said tongues are snap-fastened on the case when the transmission member is in a fully inserted position in the case.

25. A device according to claim 1, wherein the transmission member includes four slots, and the applicator includes four studs engageable with said slots.

26. A device according to claim 1, wherein the case comprises at least one inside threading, the applicator including a stud configured for cooperating with said threading so that turning the applicator relative to the case is accompanied by an axial displacement of the applicator relative to the case.

27. A device according to claim 26, wherein the threading comprises four parallel threads.

28. A device according to claim 1, wherein the transmission member includes at least a first fixing element and wherein the receptacle includes at least a second fixing element at one end configured for cooperating with the first fixing element when the receptacle is put into place.

29. A device according to claim 28, wherein said second fixing element comprises at least one fixing tab.

30. A device according to claim 29, wherein the receptacle comprises two fixing tab configured for snap-fastening to the transmission member.

31. A device according to claim 30, wherein the first fixing element comprises at least one opening suitable for receiving a tooth of a fixing tab.

32. A device according to claim 31, wherein one of the receptacle and the transmission member comprises an element defining a V-groove and the other of the receptacle and the transmission member comprises an element with a profile in a plane including the axis of the case that is substantially complementary to said groove.

33. A device according to claim 1, wherein the receptacle comprises at least a first positioning portion in relief, and the transmission member comprises at least a second positioning portion in relief suitable for cooperating with the first positioning portion so as to position the receptacle in a predetermined position relative to the transmission member.

34. A device according to claim 33, wherein each of the first and second positioning portions in relief includes at least one sloping surface.

35. A device according to claim 1, wherein said case comprises at least a first portion in relief on its inside face and said transmission member comprises at least one second portion in relief suitable for going past said first portion in relief when the transmission member is turned relative to the case.

36. A device according to claim 35, wherein the first portion in relief comprises two diametrically opposite splines parallel to the axis of the case.

37. A device according to claim 35, wherein said second portion in relief goes past said first portion in relief substantially at the end of the movement for fixing the applicator to the case.

38. A device according to claim 1, wherein the substance is in the form of a cake.

39. A device according to claim 1, wherein the applicator is configured to enable the substance to be applied to one of the lips, the eyelids, the eyelashes and the eyebrows.

40. A device according to claim 1, wherein the shutter is made of a material that is at least one of partially transparent and translucent.

41. A device for applying at least one substance, the device comprising:

a case having an axis and at least one side opening;

an applicator that is realisably fixed to the case;

a shutter that is movable relative to the case at least between a first position allowing the substance to be taken through the side opening and a second position preventing access to the substance through the side opening;

a transmission member for transmitting movement of the applicator relative to the case so as to cause the shutter to move relative to the case, said movement taking place between said first and second positions; and a receptacle containing the substance and insertable into the case along the axis of the case with the transmission member inside the case.

42. A device according to claim 41, wherein the applicator comprises four studs engageable with a multiple threading of the case.

43. A device according to claim 42, wherein said transmission member comprises four slots with openings that diverge towards the outside into which the studs can engage.

44. A device according to claim 43, wherein the slots present opposite edges having mutually parallel rectilinear portions.

45. A device comprising:

a case comprising a first opening and a second opening;

a receptacle disposed in the case relative to a transmission member, the receptacle comprising a third opening and containing a substance;

an applicator realisably fixed to the case, the applicator configured for displacing the transmission member, wherein the displacing of the transmission member adjusts the device between an open position and a closed position, the first opening and the third opening being aligned in the open position to provide access to the substance, wherein the case and the transmission member are configured so that the receptacle may be inserted in the case while the device is in the closed position.

46. A device according to claim 45, wherein the receptacle includes a shutter wall for blocking access to the substance when the device is in the closed position.

47. A device according to claim 45, wherein the transmission member includes a shutter wall for blocking access to the substance when the device is in the closed position.

* * * * *